US009387909B2

(12) United States Patent
Boerleider et al.

(10) Patent No.: US 9,387,909 B2
(45) Date of Patent: Jul. 12, 2016

(54) MOORING DEVICE FOR MOORING A SHIP

(71) Applicant: European Intelligence B.V., Dordrecht (NL)

(72) Inventors: Johan Marlon Boerleider, Dordrecht (NL); Gerardus Antonius Jozef Mampaeij, Dordrecht (NL); Stijn Leenders, Dordrecht (NL); Wouter van Reenen, Dordrecht (NL)

(73) Assignee: EUROPEAN INTELLIGENCE B.V., Dordrecht (NL)

( * ) Notice: Subject to any disclaimer, the term of this patent is extended or adjusted under 35 U.S.C. 154(b) by 0 days.

(21) Appl. No.: 14/668,585

(22) Filed: Mar. 25, 2015

(65) Prior Publication Data

US 2015/0197315 A1 Jul. 16, 2015

Related U.S. Application Data

(63) Continuation of application No. PCT/NL2013/050640, filed on Sep. 5, 2013.

(30) Foreign Application Priority Data

Sep. 25, 2012 (NL) ..... 2009515

(51) Int. Cl.
*B63B 21/02* (2006.01)

(52) U.S. Cl.
CPC ..... *B63B 21/02* (2013.01)

(58) Field of Classification Search
CPC ..... B63B 21/02
USPC ..... 114/230.1–230.15
See application file for complete search history.

(56) References Cited

U.S. PATENT DOCUMENTS

| | | | | |
|---|---|---|---|---|
| 7,052,447 | B2 * | 5/2006 | Whittaker | A63B 27/00 2/115 |
| 2006/0087391 | A1 * | 4/2006 | Ferro | B63B 21/02 335/284 |
| 2007/0084395 | A1 * | 4/2007 | Hamilton | B63B 21/02 114/230.1 |
| 2009/0123233 | A1 * | 5/2009 | Herzogenrath | B63B 21/02 405/70 |
| 2012/0305728 | A1 * | 12/2012 | Gravendeel | A63B 27/00 248/309.4 |

(Continued)

FOREIGN PATENT DOCUMENTS

| | | | | |
|---|---|---|---|---|
| CH | WO 9716341 | A1 * | 5/1997 | B63B 21/02 |
| IT | WO 2008142716 | A2 * | 11/2008 | B23Q 3/154 |
| NL | WO 2010053368 | A1 * | 5/2010 | B63B 21/02 |

(Continued)

*Primary Examiner* — Lars A Olson
*Assistant Examiner* — Jovon Hayes
(74) *Attorney, Agent, or Firm* — Jeffrey D. Myers; Peacock Myers, P.C.

(57) ABSTRACT

Mooring device for mooring a ship and comprising a base, a movable arm construction supported by the base, and at least one magnet mounted in a frame, which frame is supported by the movable arm construction, and wherein for mooring the ship the at least one magnet is arranged to attract the ship's hull, wherein at or near the at least one magnet a force generating device is provided comprising a movable force exerting part for applying a force on the ship's hull in order to test whether the magnet attracting the ship's hull provides at least a required mooring force, and that means for measuring for measuring the distance between the at least one magnet and the ship's hull are provided that are connected or connectable to a detection device for detecting whether or not the magnet is loose from the ship's hull.

9 Claims, 5 Drawing Sheets

(56) References Cited

U.S. PATENT DOCUMENTS

| | | | | |
|---|---|---|---|---|
| 2015/0047545 | A1* | 2/2015 | Boerleider | B63B 21/02 114/230.15 |
| 2015/0197315 | A1* | 7/2015 | Boerleider | B63B 21/02 114/230.15 |

FOREIGN PATENT DOCUMENTS

| | | | |
|---|---|---|---|
| WO | 2008142716 | A2 | 11/2008 |
| WO | 2010053368 | A1 | 5/2010 |
| WO | 2011053140 | A1 | 5/2011 |

* cited by examiner

MOORING DEVICE FOR MOORING A SHIP

CROSS-REFERENCE TO RELATED APPLICATIONS

This application is a continuation application of Patent Cooperation Treaty Application No. PCT/NL2013/050640, filed on Sep. 5, 2013, which claims priority to Netherlands Patent Application No. 2009515, filed on Sep. 25, 2012, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a mooring device for mooring a ship and comprising a base, a movable arm construction supported by the base, and at least one magnet mounted in a frame, which frame is supported by the movable arm construction, and wherein for mooring the ship the at least one magnet is arranged to attract the ship's hull. The invention also relates to a method for mooring a ship using such a mooring device.

2. Description of Related Art

A mooring device is known from WO2010/053368. According to this citation the mooring device is placed ashore and is used for moving the magnet to the ship's hull and mounting the ship to the quayside. According to one of the aspects of the invention the mooring device can however also be mounted on the ship, wherein the magnet is connected to a magnetizable fixture onshore. The mooring device can also be used for connecting one ship to another ship. The magnet to be employed can be either permanent, semi-permanent or it can be an electromagnet.

There is a need to ensure, preferably automatically, that the ship is reliably moored when use is made of a mooring device.

From WO 2011/053140 a magnetic anchoring method and device is known comprising a magnet unit configured to generate a magnetic field to develop an attracting force between the magnet unit and a wall structure. The magnetic anchoring device of this citation further comprises a force generating device configured to engage the magnet unit, and to generate a test force in a predetermined direction between the magnet unit and the wall structure, and a force measuring device connected to the force generating device, and configured to measuring the test force.

BRIEF SUMMARY OF THE INVENTION

An object of the invention is to improve and simplify the known magnetic anchoring method and device. A further object is to make the known method and device practically suitable for day to day use in a real life environment, and make it in principle possible that the anchoring or mooring of the ship can be performed at least in part automatically. These and other objectives will become apparent from the following disclosure of the invention.

According to a first aspect of the invention, at or near the at least one magnet of the mooring device a force generating device is provided comprising a movable force exerting part for applying a force on the ship's hull in order to test whether the magnet attracting the ship's hull provides at least a required mooring force, and that means for measuring a distance between the at least one magnet and the ship's hull are provided that are connected or connectable to a detection device for detecting whether or not the magnet is loose from the ship's hull. In this very elegant way the requirement of WO 2011/053140 to measure the test force that is applied between the magnet and the ship's hull with a force measuring device is obviated so that the teaching of this citation is not used in the instant invention.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
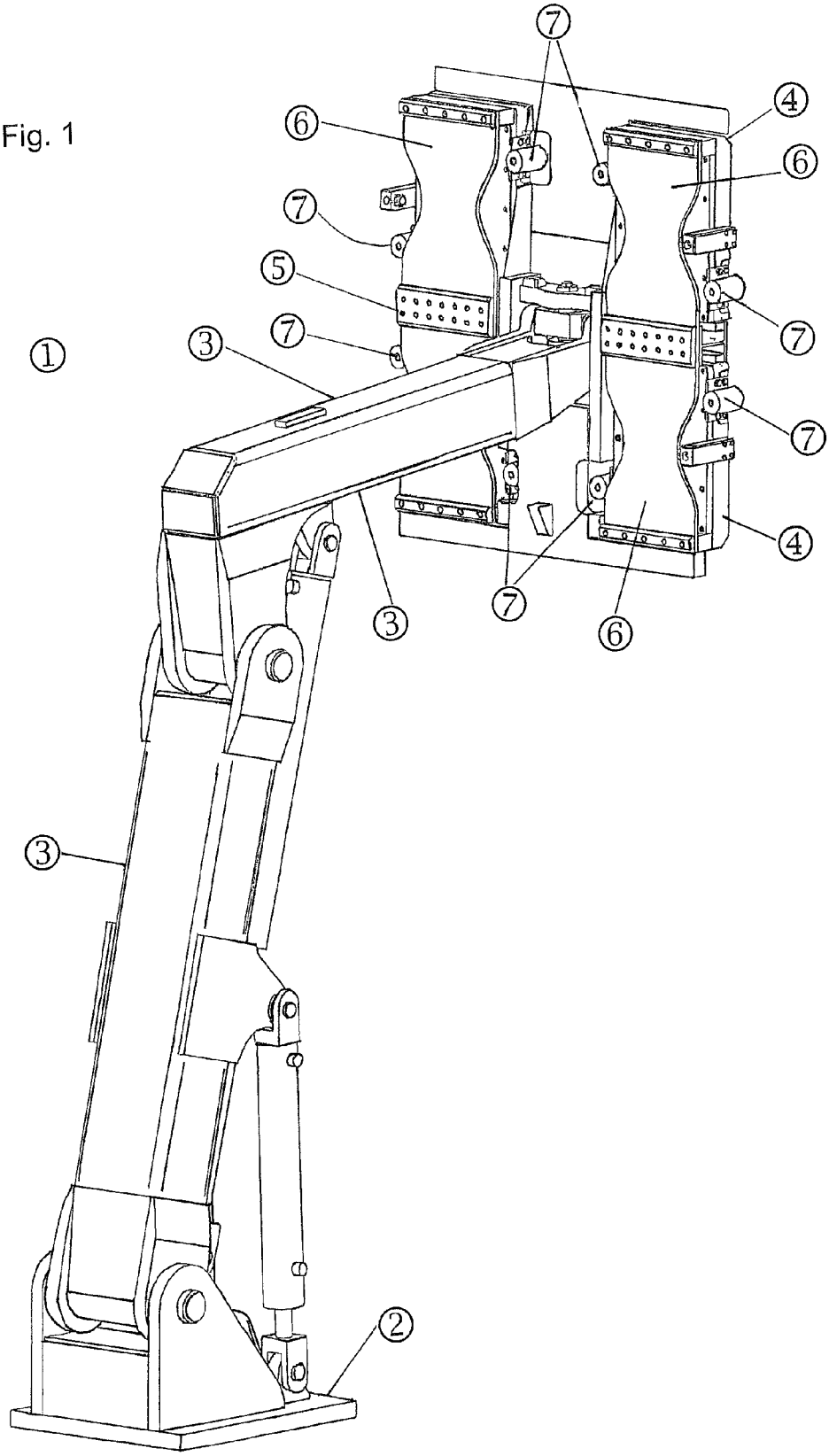
FIG. 1 shows the mooring device of the invention in a perspective view from the back.

According to the invention a method for mooring a ship is proposed using said mooring device, wherein the ship's hull is attracted with the at least one magnet, and that after initial mooring wherein the magnet or magnets are close enough to attract the ship's hull, the movable force exerting part is activated for applying a force on the ship's hull in order to test whether the magnet attracting the ship's hull provides at least a required mooring force. According to the invention this is done by monitoring a distance between the magnet and the ship's hull so as to detect whether the magnet meets the required mooring force.

Suitably the means for measuring the distance between the magnet and the ship's hull is embodied as a contact switch or proximity switch for measuring the presence of the ship's hull. Such a switch is all that is required to monitor whether the attachment of the magnet to the ship's hull is lost or not. It is however also possible that an excursion of the movable force exerting part is measured for detecting whether or not the distance between the magnet and the ship's hull is increased in comparison with the distance when the initial mooring is complete.

Preferably the movable force exerting part comprises a hydraulic cylinder fender having a preferential position in which the fender protrudes beyond the magnet's surface for contacting the ship's hull so as to arrange that during mooring the fender's frontal surface engages the ship's hull prior to the magnet coming to its closest position with reference to the ship's hull. The moment the fender engages in contact with the ship's hull the fender's hydraulic system detects the change in hydraulic pressure, which may be used to initiate the final steps before coupling the mooring magnets to the ship's hull. These steps entail increasing the pressure exerted by the hydraulic cylinder fender onto the hull in such a manner that it will exceed the cylinder's force capacity, with a slow depression of said cylinder as a result. When the hydraulic system reaches the priorly established required forces for more than for instance 2 seconds, it can be concluded that the mooring device has reached its optimal position and the magnets of the device will be switched on and coupled with the hull. This arranges for a beneficial aspect of the method of the invention, in which the fender protruding beyond the magnet's surface arranges for a soft engagement with the ship's hull. Then after the initial mooring operation according to this method in which the fender gets depressed, the hydraulic cylinder of the fender is further loaded so as to apply a force on the fender towards its preferential position in order to detect whether the fender moves back to the said preferential position. If the fender does not move, the magnet meets the required mooring force.

Although the foregoing discusses the mooring device of the invention with reference to the application of at least one magnet, the mooring device of the invention preferably comprises a plurality of magnets, wherein each magnet is provided with a force generating device or devices assigned to that particular magnet. One preferred embodiment has four magnets, positioned in a square of 2×2. When indeed the applied mooring device comprises four magnets positioned in a square of 2×2, and each magnet is provided with a force generating device or devices assigned to that particular magnet, the method of the invention to moor a ship is preferably carried out such that in a first step all force generating devices are activated, and that thereafter:

If all the magnets meet the required mooring force, the ship is deemed moored; and that If a first one of the magnets does not meet the required mooring force, a first force it is able to attain is measured and the required mooring force minus this measured first force of the first detached magnet are redistributed among the remaining three magnets; and If all of the magnets then meet the required redistributed mooring force, the ship is deemed moored; and that If after the redistribution of forces a second magnet fails to attain the increased required force, it is measured what second force it can then hold and the remaining needed force (total mooring force needed minus measured first hold force of the first detached magnet and minus the measured second hold force of the second detached magnet) is then redistributed over the remaining two magnets; and If all of the magnets then meet the required redistributed mooring force, the ship is deemed moored; and that If after the redistribution of forces a third magnet fails to attain the increased required force, it is measured what third force it can then hold and the remaining needed force (total mooring force needed minus measured first hold force of the first detached magnet, minus measured second hold force of the second detached magnet and minus measured third hold force of the third magnet is then redistributed to the remaining one magnet, and If all of the magnets then meet the required redistributed mooring force, the ship is deemed moored; and that If the fourth magnet does not meet the required mooring force the magnet and the ship are moved with respect to each other and the procedure is repeated with said first step.

Whenever in the figures the same reference numerals are applied, these numerals refer to the same parts.

With reference first to FIG. 1, the mooring device 1 of the invention is shown in a perspective view from behind. This mooring device 1 for mooring a ship comprises a base 2, a movable arm construction 3 supported by the base 2, and at least one but in practice usually several (preferably four) magnets 4 mounted in a frame 5. The magnets 4 are placed in a square of 2×2 as may be best seen in FIG. 2. The frame 5 is supported by the movable arm construction 3. As shown in FIG. 1 the frame 5 is provided with at least one but usually several leaf springs 6, wherein each magnet 4 is supported by one leaf spring 6.

Figure 2:
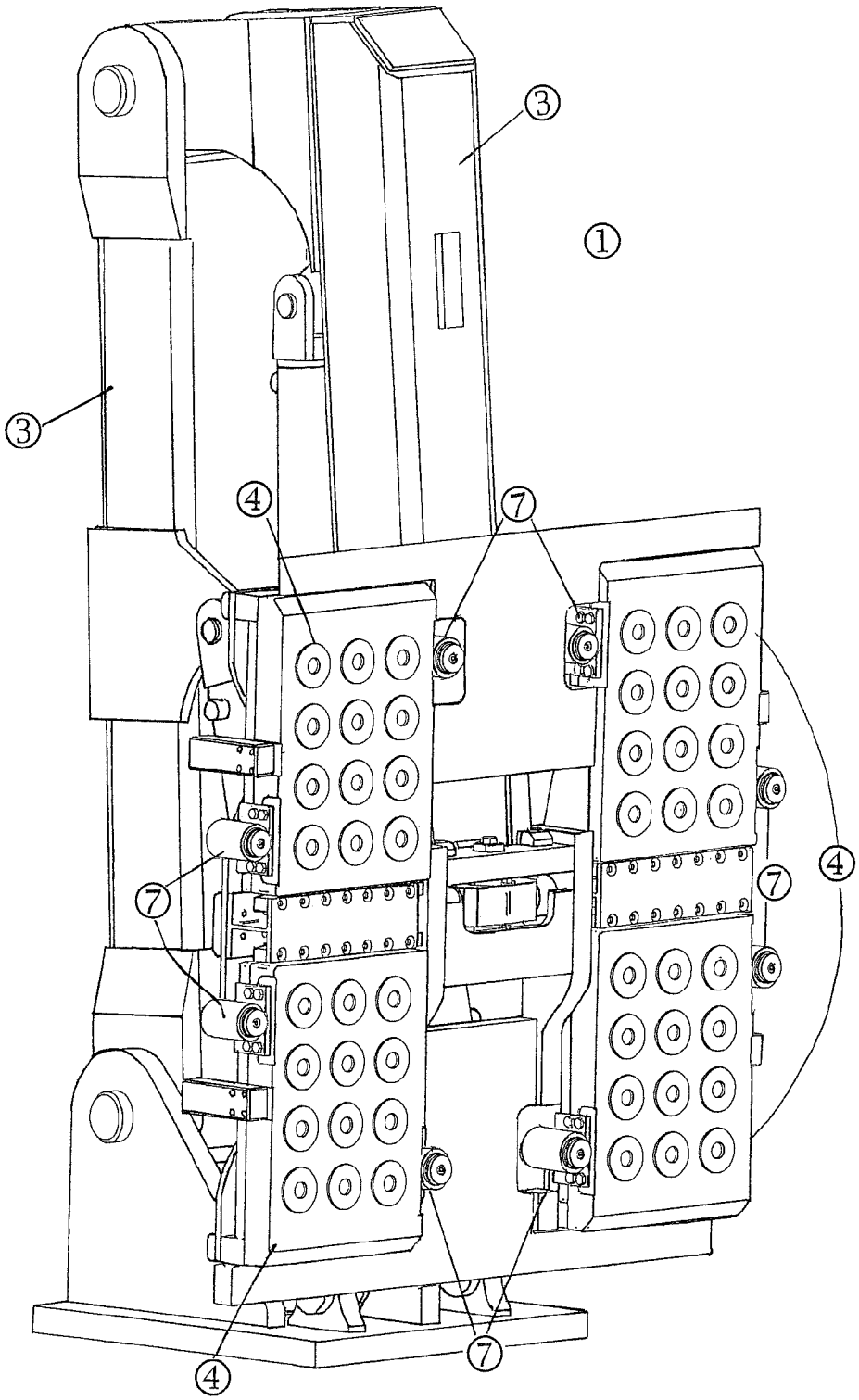
FIG. 2 shows a perspective frontal view at the mooring device of the invention.

FIG. 1 and the perspective frontal view of FIG. 2 show that near to each magnet 4 several force generating devices 7 are provided that are assigned to such magnet. It is also possible to apply a single force generating device 7.

Figure 3A:
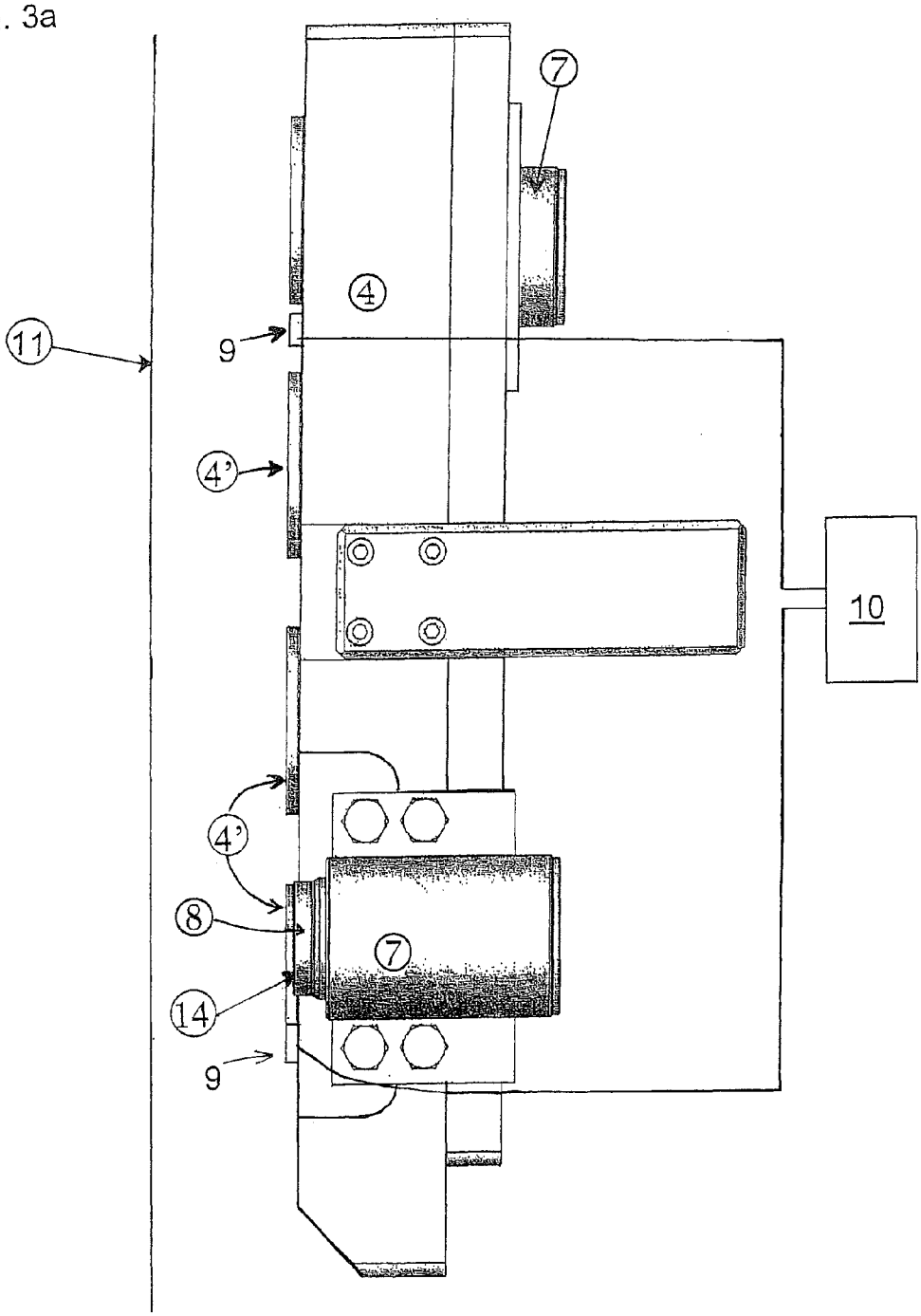
FIGS. 3*a*, 3*b* and 3*c* show in a side view, frontal view and isometric view, respectively one magnet together with a force generating device or devices forming part of the mooring device of the invention.
Figure 3B:
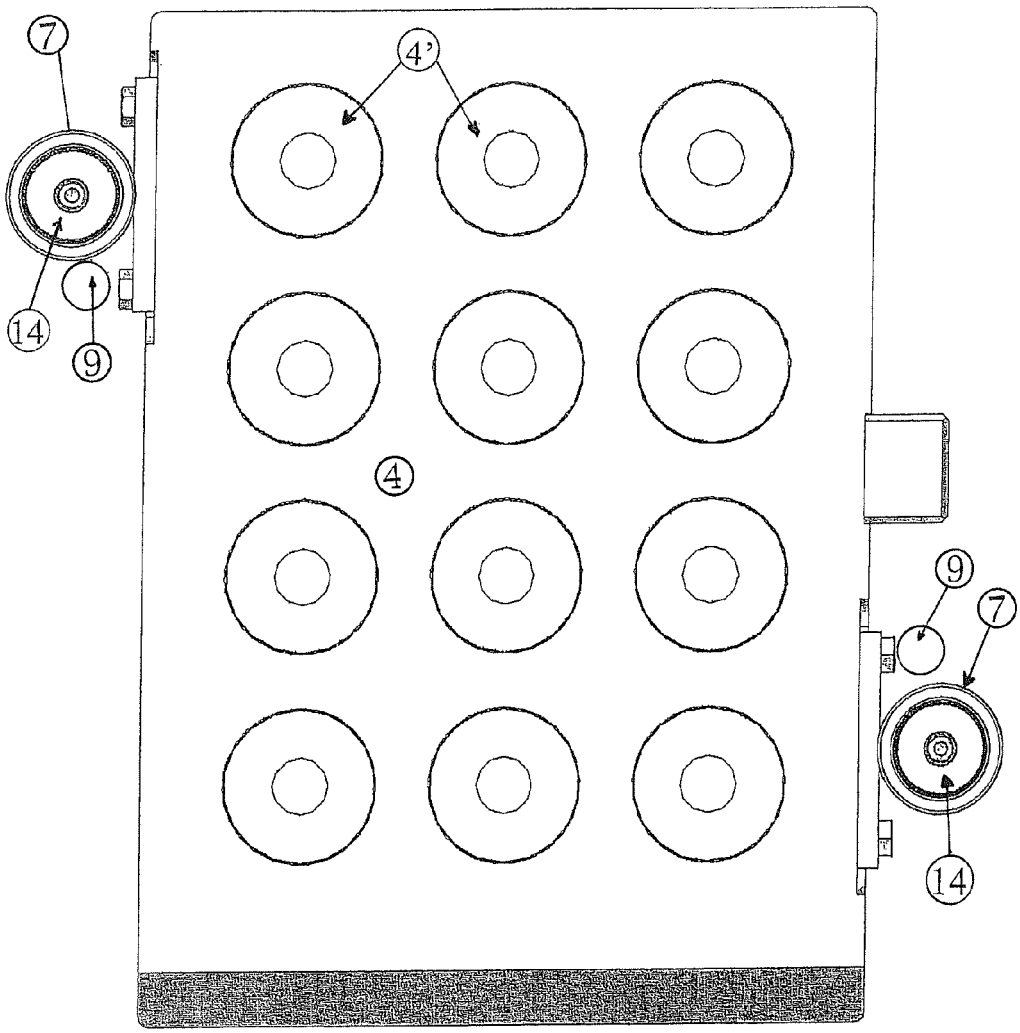
Figure 3C:
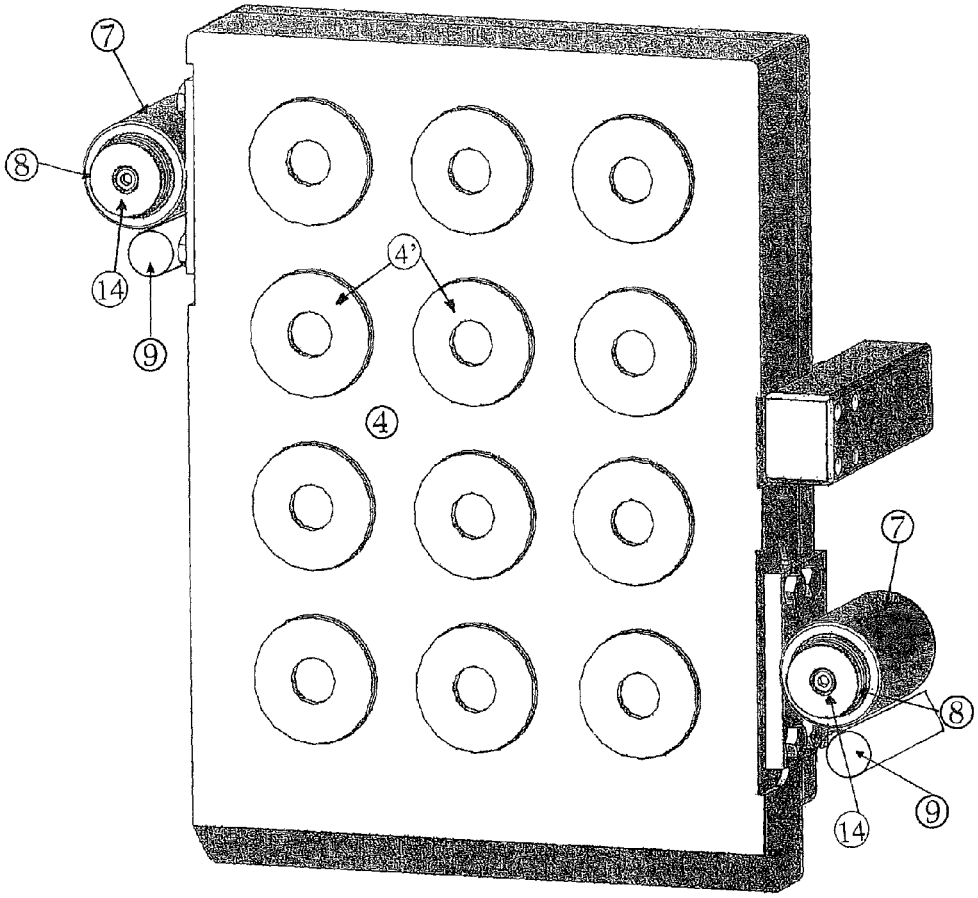

FIGS. 3*a*, 3*b* and 3*c* provide a detailed view of the force generating device or devices 7 which are applied in combination with the magnet 4. The force generating device 7 comprises a movable force exerting part 8 which is intended for applying a force on a ship's hull 11. The force exerting part 8 is then used in order to test whether the magnet 4 attracting the ship's hull 11 provides at least a required mooring force. Further there are means 9 provided for measuring the presence of an object, in particular a ship's hull 11, which means 9 are connected or connectable to a detection device 10 for detecting whether or not the magnet 4 is loose from the ship's hull 11.

The means 9 for measuring the presence of the ship hull 11 can suitably be embodied as a contact switch or proximity switch 9. Of course other options are feasible as well. It is for instance possible to measure the excursion of the movable force exerting part 8, and take this as an indication whether or not the contact of the magnet 4 with the ship's hull 11 is lost.

FIGS. 3*a*, 3*b* and 3*c* show the preferable embodiment in which the movable force exerting part 8 comprises a preferably padded hydraulic cylinder fender 14. This fender 14 has a preferential position in which the fender 14 protrudes beyond the magnet's most forward surface 4' for contacting the ship's hull 11 so as to arrange that during mooring the fender's frontal surface 14' engages the ship's hull 11 first and prior to the magnet 4 arriving at its closest position with respect to the ship's hull 11 at the time that the initial mooring is complete, and testing of the then present mooring forces will be executed.

The hydraulic cylinder of the fender is activated for testing the mooring force of the magnet 4 as will become clear from the following description.

During use the mooring device of the invention operates as follows. After the initial engagement of the magnets 4 with the ship's hull 11, the movable force exerting part 8 of the force generating device 7 is activated for applying a force on the ship's hull 11 in order to test whether the magnet 4 attracting the ship's hull 11 provides at least a required mooring force. During this process the distance between the magnet 4 and the ship's hull 11 is monitored with the means 9 for measuring the presence of an object, so as to detect whether the magnet 4 meets the required mooring force. This can also be done by measuring an excursion of the movable force exerting part 8 in order to detect whether or not the distance between the magnet 4 and the ship's hull 11 is increased in comparison with the distance immediately following the initial mooring when the attraction is brought about between the magnet 4 and the ship's hull 11.

In connection with the initial approaching of the magnet 4 and the ship's hull 11, a beneficial aspect of the mooring device of the invention is that the movable force exerting part 8 is embodied with a padded hydraulic cylinder fender 14 having a preferential position in which the button 14 protrudes beyond the magnet's surface 4' for soft engagement with the ship's hull 11. After the initial mooring operation with this soft engagement in which the fender 14 is depressed, the cylinder of the device is further loaded so as to apply a force on the fender 14 aimed at having it turn back towards its preferential position in order to detect whether the fender 14 indeed moves back to its preferential position or not. In the latter situation that it does not move back the concerning magnet 4 is deemed to meet the required mooring force.

When the applied mooring device as is shown in FIG. 1 and FIG. 2 comprises a plurality of four magnets positioned in a square of 2×2, and each magnet 4 is provided with a force generating device or devices 7 assigned to that particular magnet, the checking procedure applying to the mooring process is carried out such that in a first step all force generating devices 7 are activated, and that:

If all of the magnets 4 meet the required mooring force, the ship is deemed moored; and that If a first one of the magnets 4 does not meet the required mooring force, a first force it is able to attain is measured and the required mooring force minus this measured first force of the first detached magnet are redistributed among the remaining three magnets; and If all of the magnets then meet the required redistributed mooring force, the ship is deemed moored; and that If after the redistribution of forces a second magnet 4 fails to attain the increased required force, it is measured what second force it can then hold and the remaining needed force (total mooring force needed minus measured first hold force of the first detached magnet 4 and minus the measured second hold force of the second detached magnet 4 is then redistributed over the remaining two magnets; and If all of the magnets then meet the required redistributed mooring force, the ship is deemed moored; and that If after the redistribution of forces a third magnet fails to attain the increased required force, it is measured what third force it can then hold and the remaining needed force (total mooring force needed minus measured first hold force of the first detached magnet 4, minus measured second hold force of the second detached magnet 4 and minus measured third hold force of the third magnet 4 is then redistributed to the remaining one magnet, and If all of the magnets then meet the required redistributed mooring force, the ship is deemed moored; and that If the fourth magnet does not meet the required mooring force the magnet and the ship are moved with respect to each other and the procedure is repeated with said first step.

As remarked above the mooring device of the invention may be placed ashore to connect to a ship's hull for mooring purposes. According to the invention it is however also possible to provide a ship with one or more mooring devices according to the invention.

The appended claims provide the scope of protection of the instant invention, whereas the foregoing description is intended merely to elucidate any ambiguity that may possibly reside in these claims without the intent to limit the claims to the specific embodiment that has been discussed with reference to the drawing. The scope of protection that merits the invention is therefore solely defined by the appended claims and the construction of these claims should be as broad as is warranted by the invention in view of its contribution to the prior art.

What is claimed is:

1. A mooring device for mooring a ship having a hull and comprising a base, a movable arm construction supported by the base, and at least one magnet mounted in a frame, which frame is supported by the movable arm construction, and wherein for mooring the ship the at least one magnet is arranged to attract the ship's hull, wherein at or near the at least one magnet a force generating device is provided comprising a movable force exerting part for applying a force on the ship's hull in order to test whether the magnet attracting the ship's hull provides at least a required mooring force, and wherein means for measuring a distance between the at least one magnet and the ship's hull are provided that are connected or connectable to a detection device for detecting whether or not the magnet is loose from the ship's hull, wherein the movable force exerting part comprises a hydraulic cylinder fender having a preferential position in which the fender protrudes beyond the magnet's surface for contacting the ship's hull so as to arrange that during mooring the fender's frontal surface engages the ship's hull prior to the magnet.

2. The mooring device according to claim 1, characterized in that the means for measuring the distance between the at least one magnet and the ship's hull is embodied as a contact switch or proximity switch.

3. The mooring device according to claim 1, wherein upon activation of the hydraulic cylinder fender the hydraulic cylinder fender applies a force towards a preferential position.

4. The mooring device according to claim 1, additionally comprising a plurality of magnets, wherein each magnet is provided with a force generating device or devices assigned to that particular magnet.

5. The mooring device according to claim 4, comprising four magnets, positioned in a square of 2=2.

6. A ship provided with one or more mooring devices according to claim 1.

7. A method for mooring a ship having a hull using a mooring device comprising a base, a movable arm construction supported by the base, and at least one magnet mounted in a frame, which frame is supported by the movable arm construction, and wherein for mooring the ship the ship's hull is attracted with the at least one magnet, wherein at or near the at least one magnet a force generating device comprising a movable force exerting part is activated for applying a force on the ship's hull in order to test whether the magnet attracting the ship's hull provides at least a required mooring force, and wherein a distance between the magnet and the ship's hull is monitored so as to detect whether the magnet meets the required mooring force, wherein an excursion of the movable force exerting part is measured for detecting whether or not the distance between the magnet and the ship's hull is increased.

8. The method for mooring a ship according to claim 7, wherein the movable force exerting part is embodied with a hydraulic cylinder fender having a preferential position in which the fender protrudes beyond the magnet's surface for soft engagement with the ship's hull, and wherein after an initial mooring operation in which the fender is depressed the hydraulic cylinder fender is further loaded so as to apply a force on the fender towards a preferential position in order to detect whether the fender moves back to the preferential position and/or the magnet meets the required mooring force.

9. The method for mooring a ship according to claim 7, wherein the applied mooring device comprises a plurality of four magnets positioned in a square of 2×2, wherein each magnet is provided with a force generating device or devices assigned to that particular magnet, and wherein in a first step all force generating devices are activated, and wherein:

if all the magnets meet the required mooring force, the ship is deemed moored; and wherein if a first one of the magnets does not meet the required mooring force, a first attainable force is measured and the required mooring force minus this measured first attainable force of the first detached magnet are redistributed among the remaining three magnets; and if all of the magnets then meet the required redistributed mooring force, the ship is deemed moored; and wherein if after the redistribution of forces a second magnet fails to attain the increased required force, a second attainable force is measured and the remaining needed force (total mooring force needed minus measured first attainable force of the first detached magnet and minus the measured second attainable force of the second detached magnet is then redistributed over the remaining two magnets; and if all of the magnets then meet the required redistributed mooring force, the ship is deemed moored; and wherein if after the redistribution of forces a third magnet fails to attain the increased required force, a third attainable force is measured and the remaining needed force (total mooring force needed minus measured first attainable force of the first detached magnet, minus measured second attainable force of the second detached magnet and minus measured third attainable force of the third magnet is then redistributed to the remaining one magnet, and if all of the magnets then meet the required redistributed mooring force, the ship is deemed moored; and wherein if the fourth magnet does not meet the required mooring force the magnet and the ship are moved with respect to each other and the procedure is repeated with said first step.

* * * * *